US006136154A

United States Patent [19]

Kotitschke et al.

[11] Patent Number: 6,136,154

[45] **Date of Patent: *Oct. 24, 2000**

[54] PRESS SECTION

[75] Inventors: Gerhard Kotitschke, Steinheim; Wolfgang Mayer, Heidenheim; Klaus Esslinger, Nattheim; Andreas Meschenmoser, Horgenzell, all of Germany; Günther Mohrhardt, Sao Paolo, Brazil

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/942,389

[22] Filed: Oct. 10, 1997

[30] Foreign Application Priority Data

Oct. 11, 1996 [DE] Germany ..... 196 42 046

[51] Int. Cl.[7] ..... D21F 3/04

[52] U.S. Cl. ..... 162/360.3; 162/358.3

[58] Field of Search ..... 162/360.2, 360.3, 162/358.3, 359.1

[56] References Cited

U.S. PATENT DOCUMENTS

| | | | |
|---|---|---|---|
| 4,483,745 | 11/1984 | Wicks et al. | 162/360.2 |
| 4,923,570 | 5/1990 | Steiner et al. | 162/358.3 |
| 4,988,410 | 1/1991 | Meinecke et al. | 162/360.3 |
| 5,084,139 | 1/1992 | Autio | 162/360.3 |
| 5,092,962 | 3/1992 | Koski | 162/360.3 |
| 5,256,257 | 10/1993 | Schiel | 162/360.3 |
| 5,865,954 | 2/1999 | Laapotti | 162/360.3 |

FOREIGN PATENT DOCUMENTS

| | | | |
|---|---|---|---|
| 0496965 | 8/1992 | European Pat. Off. . | |
| 273783 | 1/1913 | Germany | 162/360.3 |
| 3808293 | 9/1989 | Germany . | |
| 9203395 | 6/1992 | Germany . | |
| 9206340 | 9/1992 | Germany . | |
| 2218122 | 11/1989 | United Kingdom . | |

*Primary Examiner*—Karen M. Hastings
*Attorney, Agent, or Firm*—Greenblum & Bernstein, P.L.C.

[57] ABSTRACT

Press section of a machine for manufacturing a fibrous pulp web. The press section may include a press roll, at least one flexible circulating press belt, at least one press shoe, and at least one extended press nip formed to extend in a web run direction by the press shoe pressing the flexible circulating press belt against the press roll. The press section further includes one of a felt or screen belt that may be guided through the at least one extended nip, and the press roll may be substantially centrally located within the press section and may have a diameter greater than a diameter of the at least one flexible circulating press belt. The center press roll has two press shoes positioned opposite it; the two press shoes are offset with respect to one another such that the direction of force exerted by each extends through the center press roll axis and defines an acute angle, with support elements within the center press roll positioned opposite the press shoes.

21 Claims, 5 Drawing Sheets

PRESS SECTION

CROSS-REFERENCE TO RELATED APPLICATION

The present application claims priority under 35 U.S.C. §119 of German Patent Application No. 196 42 046.6 filed Oct. 11, 1997, the disclosure of which is expressly incorporated by reference herein in its entirety.

BACKGROUND OF THE INVENTION

1. Field of the Invention

The present invention relates to a press section of a machine for manufacturing a fibrous pulp web, e.g., a paper or cardboard web. The press section may include at least one press nip (gap; opening), extending in a web run direction, through which a felt or screen belt may be guided. The at least one nip may be formed by a flexible circulating press belt pressed against a press roll via a press shoe having a concave press profile.

2. Discussion of Background Information

The advantages of long nip presses known in the prior art include that the press opening is no longer a substantially line-shaped nip, but a planiform nip, i.e., formed between substantially planar surfaces. In this manner, a longer section of a still-damp fibrous pulp web is exposed to pressure in the press nip, and, therefore, is more intensely drained than in the line-shaped nip device. In addition, the pressure in the press nip is not applied all at once. For example, the pressure can be continually raised or increased from a low value to a high value to avoid the danger of crushing the fibrous pulp web in the press nip.

In press sections known in the prior art, several roll presses are generally sequentially positioned in the web run direction and generally consist of a roll pair. This arrangement generally results in a relatively large number of press locations and rolls. Thus, the entire press section generally requires a lot of space. In many cases, the uptake of the fibrous pulp web from a screen belt of a screen section and its additional transfer is considered to be problematic.

SUMMARY OF THE INVENTION

The present invention provides a press section of the type generally described above that ensures a maximum dry content of the fibrous pulp web in an exceptionally compact construction. In this regard, the present invention utilizes a minimal number of press locations and rolls and, in particular, a minimal reverse moistening effect and a draining that preserves as much of the volume as possible.

Thus, in accordance with the present invention, only one centrally positioned, cylindrical press roll, e.g., preferably having a larger outer diameter than adjacent rolls, is provided. The cylindrical press roll may be positioned opposite at least one press shoe so that an associated flexible circulating press belt may be pressed against the press roll, thus, forming an extended press nip.

The present invention concentrates on draining the fibrous pulp web at least substantially in the area of a single, centrally located, cylindrical press roll having an larger outer diameter than adjacent rolls. In this manner, an overall a lower number of press locations and rolls are necessary and a very compact construction of the press section is achieved. In particular, because the press nip or nips extend in the web run direction, a draining that substantially always protects the volume may be ensured.

In a preferred embodiment, an outer diameter of the press roll may be greater than approximately 1500 mm, and preferably approximately 2000 mm. Further, the press roll may preferably be formed with an adjustable bending roll supported on the interior.

In particular, with respect to a maximum dry content of the fibrous pulp web, it can be advantageous if a plurality of press shoes, positioned sequentially (successively) in the web run direction, are placed opposite the press roll to create a plurality of extended nips (or gaps; openings). For example, a separate flexible circulating press belt may be associated with each of press shoes positioned opposite the press roll.

It may be particularly advantageous if at least one, and preferably each, extended press nip has only a single felt. This arrangement ensures a particularly gentle treatment of the fibrous pulp web.

The press roll may include a sealed or smooth roll surface. Because the fibrous pulp sheet is guided through each press nip while the sheet is in direct contact with the press roll, this arrangement ensures optimal smoothing of the side of the fibrous pulp facing the press roll.

In accordance with a particularly advantageous embodiment, and in particular in conjunction with a smooth press roll, the present invention provides a felt or screen belt having an open surface that may be guided through a front or leading extended press nip, i.e., extended in the web run direction, and a felt belt having a sealed or smooth surface that may be guided through a rear or trailing extended press nip, also extending in the web run direction. The felt or screen belts may be, e.g., guided through the respective press nip on the side of the fibrous pulp web that faces the press shoe. A particularly high dry content of the fibrous pulp web, in conjunction with optimal smoothness on both its sides, may be achieved due to the extended or long duration of pressure. Therefore, a smoothing on the side of the fibrous pulp web, opposite the press roll, may occur due to the felt belt having the sealed or smooth surface. Further, the fibrous pulp web treated in the rear or trailing extended press nip may receive substantially no significant markings from it associated felt belt.

In practical applications at least one, and preferably all, flexible circulating press belts include a press sleeve circulating around a non-rotating carrier and guided over the associated press shoe or shoes. Such a press sleeve may be easily sealed on the face side, resulting in a unit that is sealed to the exterior. In this manner, leakage of the lubricating fluid supplied to the press shoes may be avoided.

It may be particularly advantageous to create or form at least one smoothing slit between two sealed or smooth surfaces behind one of an only or a final extended press nip in the web run direction to serve as a drain for fibrous pulp web. This smoothing slit may be formed by the smooth roll sleeve of the press roll positioned against or opposite a smooth roll sleeve of a smoothing roll position. Thus, a particularly compact press section may be formed, and, in particular, a low two-sidedness of the fibrous pulp web may be ensured, i.e. differences with respect to the nature of the fibrous pulp web on both sides may be kept low.

The press roll may immediately take up the fibrous pulp sheet created or formed on a screen belt in a screen section. However, an additional uptake roll may not be necessary, which results in not only a simpler and more compact construction but also reduces the energy demands.

The smoothing slit can also be created or formed by a smoothing press located at a distance from the press roll. In this event, a belt having a sealed or smooth surface may be advantageously guided through at least one extended press nip created in the vicinity of the press roll and the smoothing slit. Thus, the fibrous pulp web may be transferred by the smooth belt from the extended press nip to the smoothing slit.

In each case, the additional smoothing slit may substantialy eliminate the possible occurrence of felt markings. Further, the two-sidedness of the fibrous pulp web may also be reduced, and the rotational direction reversal for the transfer into a dryer section, which follows the press section, may be ensured. Finally, a closed web that is gentle to the fibrous pulp web guidance may be ensured.

When using a smoothing roll, positioned at a distance from the press roll, and at least one extended press nip created in the vicinity of the press roll, and when the smooth belt is guided through the smoothing slit, the fibrous pulp sheet created on the screen belt of the screen section may be taken up by the smooth belt. This preferably occurs in the vicinity of a guide roll over which the smooth belt is guided in front of the press roll in the web run direction.

A particularly compact and, with respect to the desired treatment of the fibrous pulp web, optimal arrangement may be achieved when a flexible circulating press belt having a closed or smooth surface is guided over a press shoe positioned opposite the press roll, as well as over another press shoe positioned opposite a smoothing roll. Here, too, the flexible press belt may include, e.g., a press sleeve guided over the press shoes that circulates around a non-rotating carrier. In this arrangement, the above-mentioned advantages result.

The arrangement is preferably selected such that the smooth press belt or the smooth press sleeve immediately takes up the fibrous pulp web created on the screen belt of the screen section. Accordingly, an additional uptake roll, which would otherwise be required, may be eliminated.

Also in accordance with the present invention, only one shoe press roll, preferably having a large outer diameter, may be provided that includes of a non-rotating carrier and a flexible press sleeve circulating around it that is guided over at least one press shoe. At least one cylindrical mating roll may be associated with the shoe press roll on which the press sleeve may be pressed via a respective press shoe. Thus, the outer diameter of the shoe press roll is preferably larger than that of the respective mating roll.

This alternative solution may be based, e.g., on an idea to concentrate the draining of the fibrous pulp web at least substantially in the area of one single shoe press roll which can be associated with one or more cylindrical mating rolls in order to create one or more press nips that are extended in the web run direction.

In an embodiment preferred in a practical application, the outer diameter of the shoe roll is greater than approximately 2000 mm. Further, at least one mating roll may be formed by an adjustable bending roll which is supported in the interior.

In an exemplary embodiment, the shoe roll may include two press shoes. Further, two mating rolls may be associated with the shoe roll to create the extended press nips that are to be placed one after the other, i.e., in succession or sequentially, in the web run direction.

In another preferred embodiment, at least one, and preferably each, extended press nip has only a single felt.

In another embodiment preferred in the present invention, a felt belt having an open surface may be guided through a front or leading extended press nip, extending in the web run direction, and a felt belt having a closed or smooth surface may be guided through a rear or trailing extended press nip, also extending in the web run direction. In this manner, e.g., a high dry content can be achieved along with insignificant two-sidedness and insignificant markings.

Accordingly, the present invention may be directed to a press section of a machine for manufacturing a fibrous pulp web. The press section may include a press roll, at least one flexible circulating press belt, at least one press shoe, and at least one extended press nip formed to extend in a web run direction by the press shoe pressing the flexible circulating press belt against the press roll. The press device may also include one of a felt or screen belt that may be guided through the at least one extended nip, and the press roll may be substantially centrally located within the press section and may have a diameter greater than a diameter of the at least one flexible circulating press belt.

In accordance with another feature of the present invention, the at least one press shoe may include a plurality of press shoes successively positioned with respect to each other in the web run direction and the plurality of press shoes may be positioned opposite the press roll to form the at least one extended nip. Further, a separate flexible circulating press belt may be associated with the plurality of press shoes and a single felt belt may be associated within each of the at least one extended press nip. The press roll may include one of a closed and smooth roll surface, and the at least one extended press nip may include a front and rear extended press nip that extend in the web run direction, and one of a felt or screen belt having an open surface guided through the front extended press nip. The single felt belt, having one of a sealed and smooth surface may be guided through the rear extended press nip and one of a felt and screen belt may be guided on a side of the fibrous pulp web facing the press shoe through the extended nip.

In accordance with still another feature of the present invention, the press shoe may be positioned directly underneath the press roll and a direction of force exerted by the press shoe may lies in a substantially vertical plane extending substantially through an axis of the press roll.

In accordance with a further feature of the present invention, the at least one press shoe may include two press shoes positioned opposite the press roll and offset with respect to each other in a circumferential direction to the press roll. A direction of force exerted by each of the two press rolls may extend substantially through an axis of the press roll and define an acute angle.

In accordance with a still further feature of the present invention, the at least one flexible circulating press belt may include a press sleeve circulating around a non-rotating carrier and guided over the at least one press shoe.

In accordance with a further feature of the present invention, each of the at least one flexible circulating press belt may include a press sleeve circulating around a non-rotating carrier and guided over the at least one press shoe. The at least one press shoe may include two successively arranged press shoes arranged opposite the press roll. The at least one circulating flexible roll sleeve may be guided over the two successively arranged press shoes, and an outer diameter of the press roll may be greater than a diameter of the press sleeves. The press sleeves may have substantially equal outer diameters.

In accordance with another feature of the present invention, the press section may further include a smoothing slit formed between one of two closed and two smooth surfaces, and the smoothing surface may be positioned after, in the web run direction, the at least one extended press nip to drain the fibrous pulp sheet. The at least one extended press nip may be a last press nip formed by the press roll in the web run direction. Alternatively, the smoothing slit may be formed by a smooth roll sleeve of the press roll and a smooth roll sleeve of a smoothing roll positioned opposite the press roll. The smoothing roll including at least one interior support element for supporting the smooth roll sleeve of the smoothing roll and for pressing against the press roll. Further, the roll press may have an outer diameter greater than a diameter of the smoothing roll, and may further include a screen section and a screen belt, the screen section forming the fibrous pulp web on the screen belt. The press roll may be positioned to immediately take up the fibrous pulp web from the screen belt. In a further alternative, the smoothing slit may be formed by a smoothing press located at a distance from the press roll. The smoothing press may include a smoothing belt having one of a closed and smooth surface, the belt may be guided through the at least one extended press nip in a vicinity of the press roll and guided through the smoothing slit. The fibrous pulp web may be transferred from the at least one extended press nip to the smoothing slit via the smoothing belt.

In accordance with still another feature of the present invention, the at least one press shoe may include a first and second press shoe. The at least one flexible circulating press belt may have one of a closed and smooth surface guided over the first press shoe positioned opposite the press roll and may be guided over the second press shoe positioned opposite a smoothing roll. The at least one flexible circulating press belt may include a press sleeve guided over the first and second press shoes and the press sleeve may circulate around a non-rotating carrier. The press section may further include a unit including the press sleeve of at least one flexible circulating press belt and the first press shoe. The first press shoe may be positioned diagonally above the press roll and a direction of force exerted by the first press shoe against the press roll may be downward and within a plane extending substantially through an axis of the press roll, such that the direction of force and a vertical plane extending through the axis of the press roll may define an acute angle. Further, a direction of force exerted by the second press shoe may be substantially perpendicular to the direction of force exerted by the first press shoe.

In accordance with another feature of the present invention, a length of the first press shoe, in the web run direction, may be longer than a length of the second press shoe.

In accordance with another feature of the present invention, the fibrous pulp web may include one of a paper or a cardboard web.

In accordance with yet another feature of the present invention, the at least one press shoe may have a concave press profile. Further, the concave press profile may substantially correspond with a curvature an outer surface of the press roll.

The present invention is also be directed to a press section of a machine for manufacturing a fibrous pulp web. The press section may include a press roll having a flexible circulating press belt, a non-rotating carrier, and at least one press shoe such that the flexible circulating press belt may be guided over the at least one press shoe, and at least one mating roll positioned opposite the press roll. The press section may also include at least one extended press nip formed to extend in a web run direction by the at least one press shoe pressing the flexible circulating press belt against the at least one mating roll. The press section may also include one of a felt and screen belt that may be guided through the at least one extended press nip and the press roll may have a diameter greater than a diameter of the at least one mating roll.

In accordance with another feature of the present invention, the outer diameter of the shoe roll may be greater than approximately 2000 mm. Further, the at least one mating roll may be composed of an adjustable bending roll supported along an interior surface.

In accordance with still another feature of the present invention, the at least one press shoe may include two press shoes, the at least one mating roll may include two mating rolls, and the two mating rolls may form the at least one extended press nip. The at least one extended press nip may include successively positioned extended press nips in a web run direction.

In accordance with a further feature of the present invention, the at least one extended press nip may have only a single felt. Alternatively, each of the at least one extended press nips may have only a single felt.

In accordance with still another feature of the present invention, the at least one extended press nip may include a leading and a trailing extended press nip that extend in the web run direction, the press section may further include one of a felt and screen belt having an open surface guided through the leading extended press nip and a felt belt having one of a closed and smooth surface guided through the trailing extended press nip.

In accordance with yet another feature of the present invention, the press section may further include a screen section and a screen belt, and the screen section may form the fibrous pulp web on the screen belt. The at least one extended press nip may include a leading and trailing extended press nip that extend in the web run direction, and the press section may further include one of a felt and screen belt having an open surface guided through the leading extended press nip to take up the fibrous pulp web from the screen belt. Further, the press section may include a guide roll for deflecting the one of a felt and screen belt toward the leading press nip. The taking up of the fibrous pulp web may occur in a vicinity of the guide roll.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

FIGS. 1 through 5 each illustrate purely schematic displays of alternative press sections of a machine for manufacturing a fibrous pulp web 10, e.g., a paper or cardboard web. The depicted press sections each include at least one press nip (gap; opening) P that extends in a web run direction L and that is created or formed by a flexible circulating press belt pressed against a press roll via a press shoe having a concave press profile. The at least one nip is also associated with a single felt.

In each of the embodiments depicted in FIGS. 1–4, only one centrally positioned cylindrical press roll 12 is provided with a diameter greater than that of the adjacent rolls.

Figure 1:
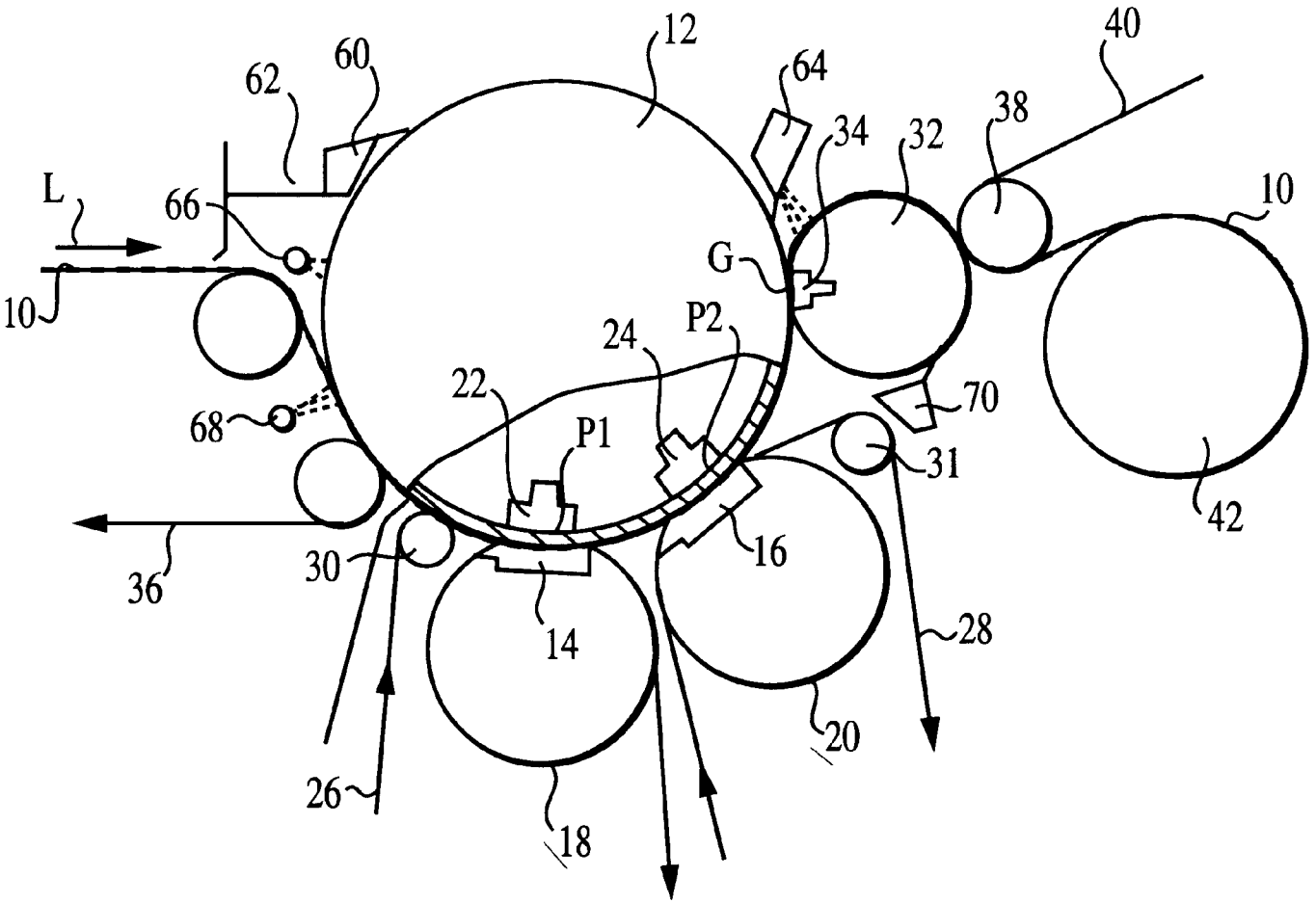
FIG. 1 illustrates a schematic side view of an embodiment of a press section having a single, centrally arranged, cylindrical press roll and two opposing press shoes.

In the embodiment displayed in FIG. 1, press shoes 14 and 16, having a concave press area, may be positioned opposite to a single, centrally arranged, cylindrical press roll 12. Press shoes 14 and 16 may be associated with flexible circulating press belts, formed by press sleeves 18 and 20, respectively, such that the flexible circulating press belts may be pressed against press roll 12 to create extended press nips P1 and P2, respectively. Press sleeves 18 and 20 may be arranged to circulate around a non-circulating carrier and may be guided over respective press shoes 14 and 16. In the present case, a separate flexible press sleeve 18 and 20 may be associated with each of the two press shoes 14 and 16.

An outer diameter of press roll 12 may be larger than approximately 1500 mm, and preferably approximately 2000 mm. Press roll 12 may be, e.g., an adjustable bending roll having support elements 22 and 24 for supporting the interior surface of the roll and having a closed or smooth roll surface.

A felt or screen belt 26, having an open surface, may be guided through a front or leading extended press nip P1, which extends in the web run direction L, and a felt belt 28, having a closed or smooth surface, may be guided through a rear or trailing extended press nip P2, also extending in the web run direction. The bottom-fed felt or screen belt 26 may be deflected over a guide roll 30 before reaching press nip P1, which is formed with press roll 12 to create a tapered nip into which the fibrous pulp web 10 may be fed. Pressure on fibrous pulp sheet 10 may be applied within press nip P1 substantially only via press sleeve 18. Prior to entering press nip P1, fibrous pulp sheet 10 may be direct contact with press roll 12. In this manner, it may be ensured that fibrous pulp sheet 10 and felt or screen belt 26 do not run over a ridge that may be formed by press sleeve 18 before entering press nip P1. Thus, by locating guide roll 30 to avoid an abrupt deflection of fibrous pulp web 10, a gentle, i.e., a distortion-free, guidance of fibrous pulp sheet 10 may be ensured.

Upon exiting press nip P1, felt or screen belt 26 may be immediately separated from fibrous pulp web 10 by guiding felt or screen belt 25 downward over press sleeve 18. Felt or screen belt may be guided around additional guide rolls (not shown) to form a return path to guide roll 30.

Felt belt 28 may be fed from below over press sleeve 20 into press nip P2. Upon exiting press nip P2, felt belt 28 may be guided away from fibrous pulp web 10 and downward over a guide roll 31 and additional guide rolls (not shown) to form a return to press nip P2 over press sleeve 20.

A leading long- (or extended-) slit press unit, including press shoe 14 and flexible press sleeve 18, may be positioned directly below press roll 12 so that an upwardly directed force of press shoe 14 may lie in a substantially vertical plane and may substantially extend through an axis of press roll 12.

A trailing long- (or extended-) slit press unit, including of press shoe 16 and flexible press sleeve 20, may be positioned substantially directly adjacent, and downstream with respect to the web travel direction, of the leading long-slit press unit. Press shoe 16 may be positioned to be offset, with respect to press shoe 14, in a circumferential direction of press roll 12. Further, press shoes 14 and 16 may be positioned such that the directions of forces exerted by press shoes 14 and 16 may extend through the axis of press roll 12 and define an acute angle that measures slightly less than approximately 45°.

As depicted in FIG. 1, an outer diameter of press roll 12 may be larger than the equally-sized outer diameters of press sleeves 18 and 20.

In extended press nip P2, operating behind a final draining of fibrous pulp sheet 10 in web run direction L, a smoothing slit G may be created or formed by two closed or smooth surfaces, and may be located, in web run direction L, behind trailing (and final) extended press nip P2 to drain fibrous pulp web 10.

Smoothing slit G may be formed by the smooth roll sleeve of press roll 12 and a smooth roll sleeve of an oppositely positioned smoothing roll 32. The smooth roll sleeve of smoothing roll 32 may be supported by at least one interior support element 34 and may be pressed against press roll 12. An outer diameter of smoothing roll 32 may be less than that of press sleeves 18 and 20 and, therefore, less than the diameter of press roll 12.

Smooth press roll 12 may immediately take up fibrous pulp web 10 created on a screen belt 36 of a screen section, from screen belt 36 in the manner shown in FIG. 1.

Fibrous pulp web 10 may be transferred from smoothing roll 32, by a felt or screen belt 40 guided around a guide roll 38, to a dryer cylinder 42 of a dryer section.

In the embodiment illustrated in FIG. 1, smoothing roll 32 may be positioned adjacent to press roll 12 on the right such that a direction of force of the at least one support element 34 may be at least substantially horizontal.

Figure 2:
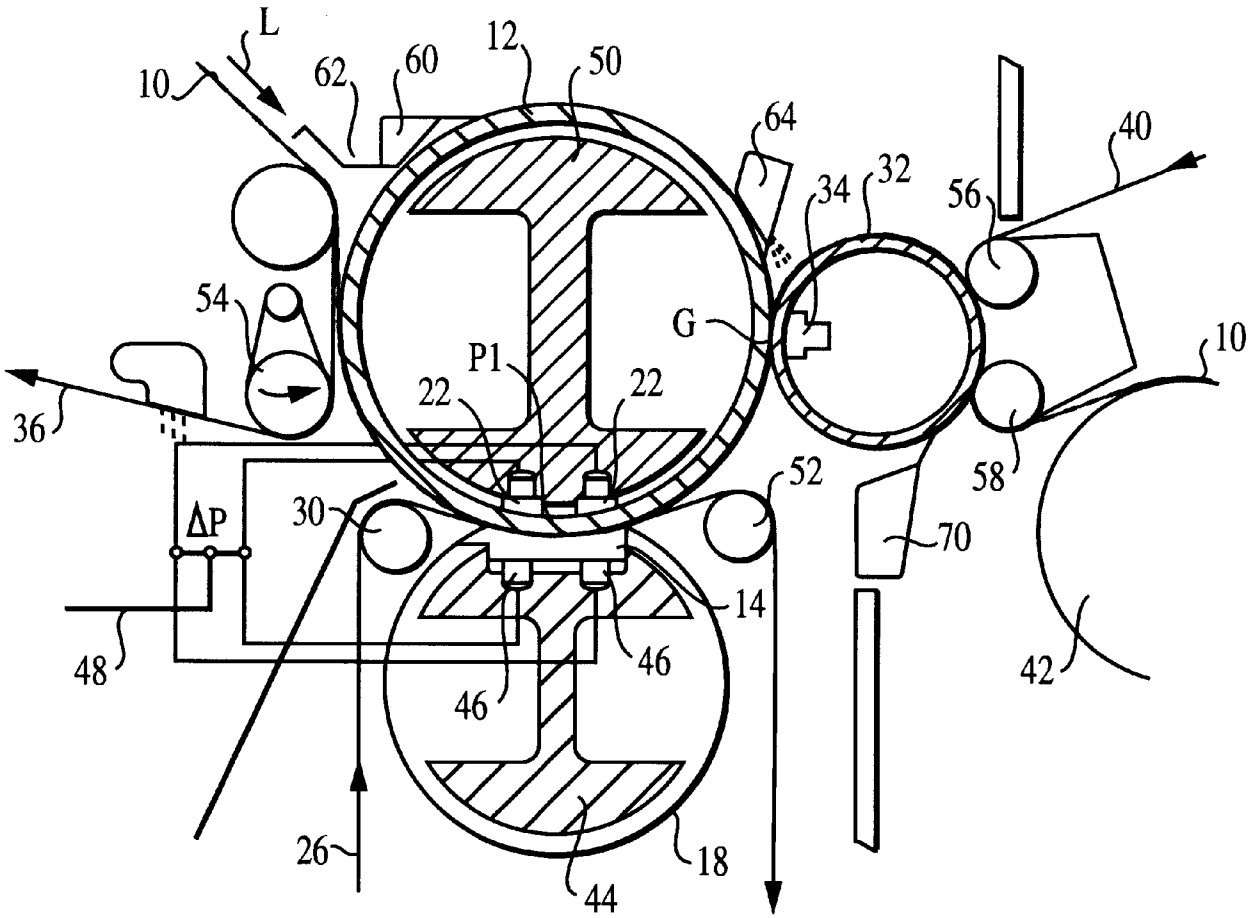
FIG. 2 illustrates a schematic side view of another embodiment of a press section having a single, centrally positioned, cylindrical press roll and only one opposing press shoe.

The embodiment in accordance with FIG. 2 may be different from that depicted in FIG. 1 in that only one long-slit press unit, including a press shoe 14 and a flexible press sleeve 18, is associated with press roll 12. The long-slit press unit may also be formed to be slightly larger than the long-slit press unit shown in FIG. 1, and may also be formed to be larger than press roll 12. The long-slit press unit of the embodiment shown in FIG. 2, including press shoe 14 and flexible press sleeve 18, may be positioned directly below press roll 12 to that an upwardly directed force exerted by press shoe 14 may lie in a vertical plane substantially extending through the axis of press roll 12.

A non-rotatable carrier 44 supporting press shoe 14 may be positioned so that press sleeve 18 is guided around non-rotatable carrier 44 and over press shoe 14. Pressurizable force units 46, for exerting pressure on press shoe 14, are also be supported by carrier 44. Force units 46 may be formed as a cylinder/piston unit and may be supplied via a line 48 with a same hydraulic fluid as interior support elements 22. Interior support elements may be arranged on a carrier 50 of press roll 10, e.g., formed as an adjustable bending roll.

Press roll 12 may preferably include a rubber coating and smoothing roll 32, arranged adjacent to, and on a downstream side of, press roll 12 may include a hard coating.

Felt or screen belt 26 may be guided over a guide roll 30 and 52, i.e., before and after extended press nip PI. In contrast to the embodiment depicted in FIG. 1, this embodiment immediately separates felt or screen belt 26 from press sleeve after the press nip P1.

As likewise depicted in FIG. 1, press roll 12 may immediately take up fibrous pulp web 10 created on screen belt 36 of the screen section. The take up of fibrous pulp web 10 may be facilitated by a deflection either toward or away from press roll 12 via adjustable guide roll 54.

Fibrous pulp web 10 may also be transferred from smoothing roll 32 to a felt or screen belt 40 and guided to a drying cylinder 42 of the drying section. In this case, felt or screen web 40 in a vicinity of smoothing roll 32 may be guided over two guide rolls 56 and 58 and may be transferred onto smoothing roll 32 for transfer of fibrous pulp web 10. Of the two guide rolls 56 and 58, the lower one, i.e., guide roll 58, may be, e.g., motorized.

In the embodiment depicted in FIG. 2 (and FIG. 1), a scraper 60 may be placed diagonally to an upper left along an outer circumference of press roll 12 to remove water. A trough 62 may further be provided to recieve the removed water from scraper 60. Trough 62 may be emptied in any conventional manner.

In a region above smoothing slit G, a steam blow box 64 or similar device can also be provided having an appropriate pressurization for fibrous pulp web 10 to be taken up by smoothing roll 32. Steam blow box 64 can furthermore be equipped with, e.g., an integrated scraper that exerts pressure on press roll 12. In addition, a spray nozzle 66 (see FIG. 1) may be associated with press roll 12 to apply a water spray mist across a region of the sleeve ahead of (upstream of) a transfer location of fibrous pulp web 10 from screen belt 36.

A blow nozzle 68 or similar device may be provided in a region in which screen belt 36 is brought into contact with press roll 12. In this manner, transfer of fibrous pulp web 10 to press roll 12 may be facilitated.

Further, a scraper 70 may be associated with smoothing roll 32 and may be positioned below smoothing roll 32, as shown in both FIGS. 1 and 2.

Press shoes 14 and 16 may be lubricated in any conventional manner, and, in particular, hydrodynamically and/or hydrostatically. After roll sleeves 18 and 20 are closed on a face side, it is ensured that no lubricating material reaches the outside.

In the embodiment in accordance with FIG. 2, smoothing roll 32 has an outer diameter that may be less than the diameter of press sleeve 18 and, therefore, less than the diameter of press roll 12.

Figure 3:
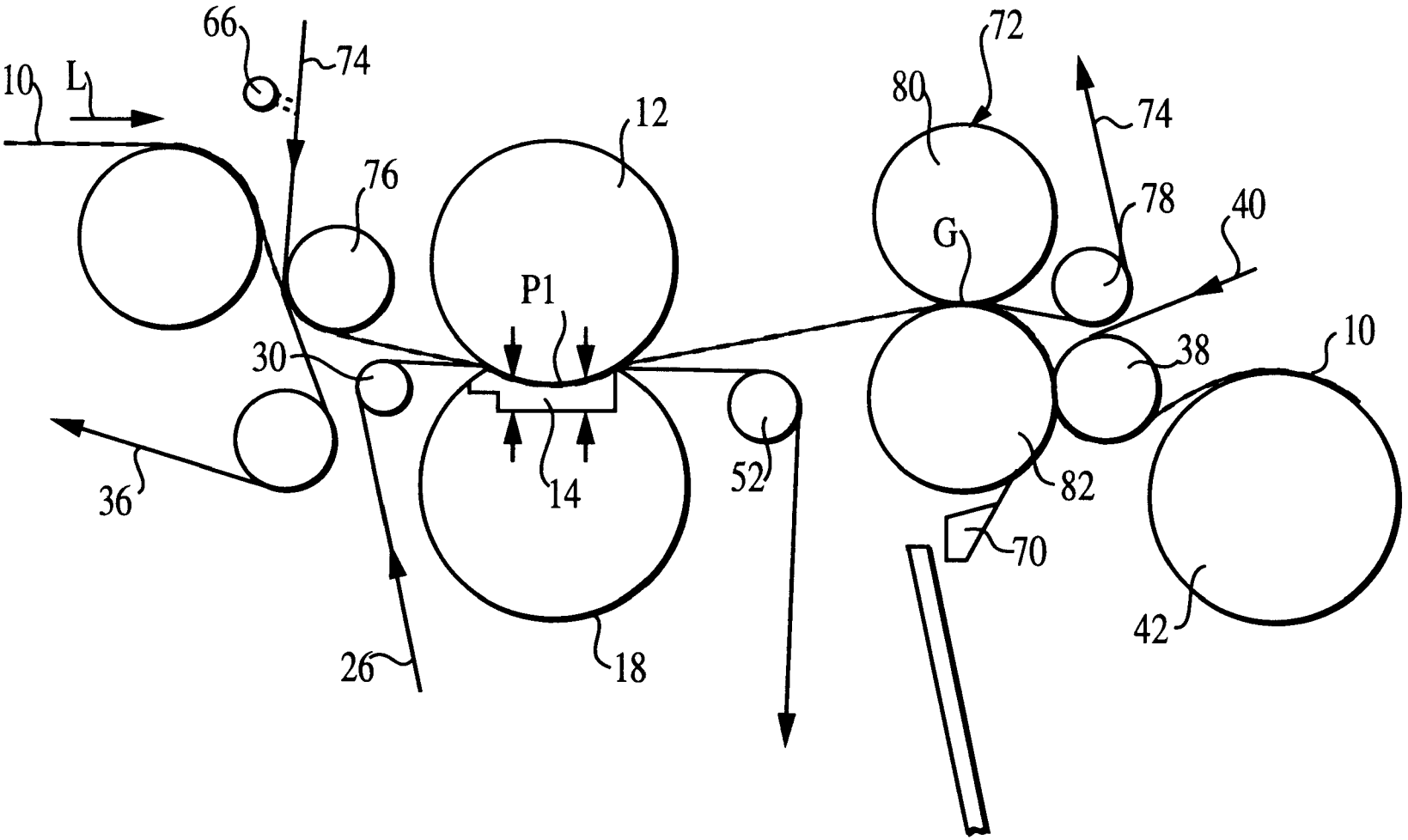
FIG. 3 illustrates a schematic side view of still another embodiment of a press section having a smoothing press arranged at a distance from the press roll.

The embodiment of a press section illustrated in FIG. 3 differs from the embodiment depicted in FIG. 2 in that smoothing slit G may be created or formed by a smoothing press 72 located at a distance from press roll 12. In this manner, a belt 74 having a closed or smooth surface may be guided through extended press nip P1, created between press roll 12 and the long-slit press unit, including press shoe 14 and flexible press sleeve 18, and through smoothing slit G. Via this arrangement, fibrous pulp web 10 may be guided from extended press nip P1 to smoothing slit G. Smooth belt 74 may be guided around guide roll 76 and 78 before reaching the extended press nip P1 and after exiting smoothing slit G, respectively. Smooth belt 74 may take up fibrous pulp web 10 formed on screen belt 36 of the screen section in a vicinity of front or leading guide roll 76, positioned a distance from press nip P1.

Felt or screen belt 26 may be guided around two guide rolls 30 and 52 and may be brought in contact with smooth press belt 74 at press nip P1. In this manner, a tapered slit may be created or formed to feed fibrous pulp web 10 carried by the smooth belt 74. As can be seen from FIG. 3, smooth belt 74 may be fed into press nip P1 substantially diagonally from above and, upon exiting press nip P1, may then be guided diagonally upward to reach smoothing press 72. Smoothing press 72 may be formed by two smoothing rolls 80 and 82 placed one atop the other. From bottom smoothing roll 82, fibrous pulp web 10 may be again transferred to a felt or screen belt 40 guided by a guide roll 38. In this manner, fibrous pulp web 10 may be guided onto a dryer cylinder 42 of the dryer section. A scraper 70 may again positioned below smoothing roll 82.

In contrast to the embodiments depicted in FIGS. 1 and 2, spray nozzle 66 is not located in the vicinity of press roll 12, but is located above guide roll 76 and directed toward smooth belt 74 at a position upstream of guide roll 76 to pressurize smooth belt 74.

Figure 4:
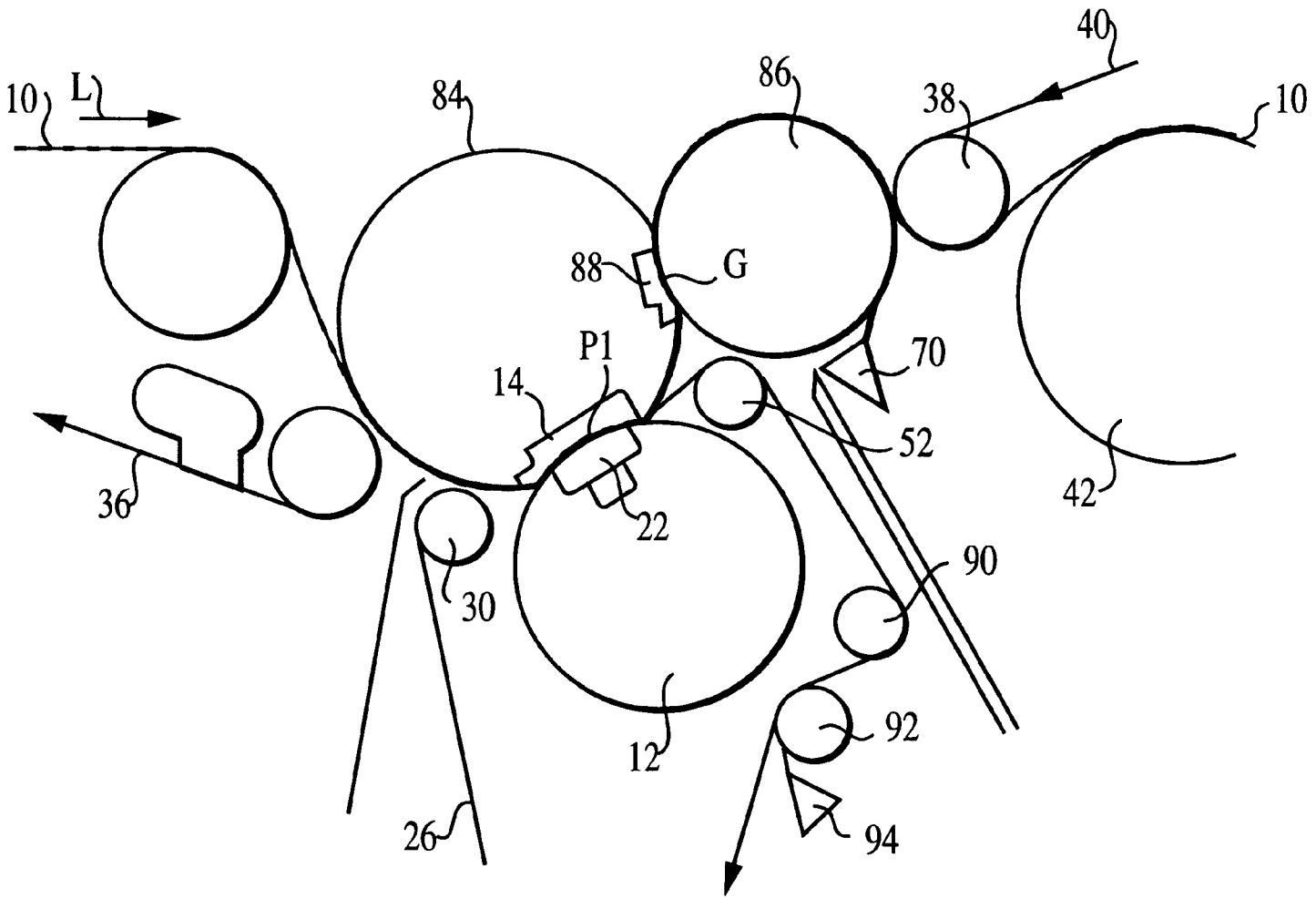
FIG. 4 illustrates a schematic side view of yet another embodiment of a press section having a press shoe positioned opposite a press roll and a press shoe positioned opposite to a smoothing roll, as well as a circulating flexible press sleeve guided over the two press shoes.

In the embodiment of a press section illustrated in FIG. 4, the flexible belt includes a press sleeve 84 circulating around a non-rotating carrier and guided over a press shoe 14 and a press shoe 88 positioned opposite press roll 12 and a smoothing roll 86, respectively.

The unit including press sleeve 84 and press shoes 14 and 88 may generally be positioned diagonally above and to the left of press roll 12. A direction of force of press shoe 14, positioned opposite press roll 12, may be exerted diagonally and downward, and lie in a plane substantially extending through the axis of press roll 12. This force plane may define an acute angle with vertical plane extending through the axis of press roll 12.

A direction of force exerted by press shoe 88 against the oppositely positioned smoothing roll 86 may be at least substantially perpendicular to the direction of the force exerted by press shoe 14 against press roll 12.

As is evident from FIG. 4, a length of press shoe 14, which is positioned opposite to press roll 12 in web run direction L, may be is longer than the length of press shoe 88.

Press sleeve 84 may have a closed or smooth surface to directly take up fibrous pulp web 10 created on screen belt 36 of the screen section.

Felt or screen belt 26 may be guided over guide rolls 30 and 52 and may be guided around press roll 12, which is supported on its interior surface by interior support element 22 and formed as an adjustable bending roll. As shown in FIG. 4, press roll 12 may be positioned diagonally below and to the right of the long-slit-press unit including press shoes 14 and 88 and flexible roll sleeve 84. Felt or screen belt 26 may be guided downward after being deflected at an angle of approximately 90° by an additional guide roll 90, and may be again deflected diagonally downward by another guide roll 92. A scraper 94 may be associated with guide roll 92 and a scraper 70 may be positioned below smoothing roll 86.

Fibrous pulp sheet 10 may again be transferred from smoothing roll 86 to a dryer cylinder 42 of a dryer section by a felt or screen belt 40 guided around a guide roll 38.

Figure 5:
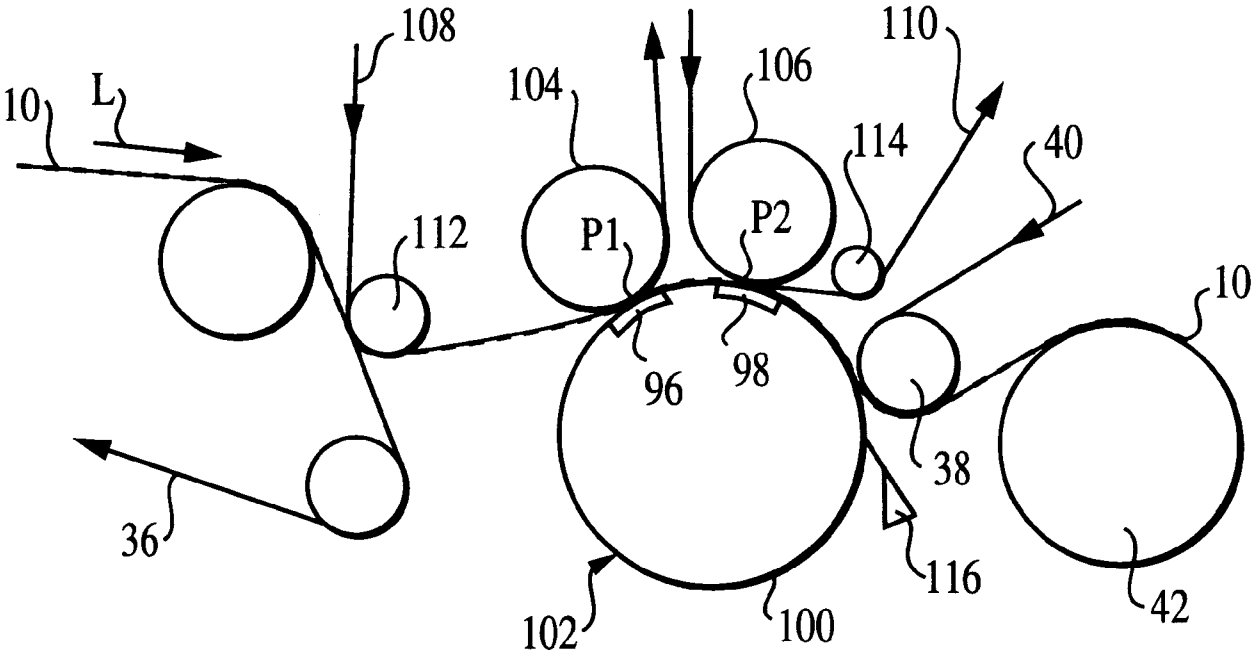
FIG. 5 illustrates a schematic side view of a still further embodiment of a press section having a single shoe roll associated with two mating rolls.

FIG. 5 illustrates an alternative embodiment of a press section of the present invention in which only one shoe roll 102 with a larger outer diameter is provided, and includes a flexible press sleeve 100 that circulates around a non-rotating carrier (not shown) and is guided over two press shoes 96, 98.

Two cylindrical mating rolls 104 and 106 may be positioned above, and associated with, shoe roll 102. Mating rolls 104 and 106 may be positioned opposite press sleeve 100 and may be pressed against press sleeve 100 via press shoes 96 and 98 in order to create or form front or leading extended press nip P1 and rear or trailing extended press nip P2. From the illustrated embodiment of FIG. 5, the two upper mating rolls 104 and 106 may be positioned to lie close together. These mating rolls 104 and 106 have a same outer diameter, which may be significantly smaller than the diameter of shoe roll 102. The outer diameter of shoe roll 102 may be, e.g., greater than approximately 2000 mm. Mating rolls 104 and 106 may be formed as adjustable bending rolls that are supported in the interior.

Extended press nips P1 and P2 may be sequentially (or successively) arranged in web run direction L, and each may have a single felt guided through the extended nip. A felt or screen belt 108 having an open smooth surface may be guided through the front extended press nip P1 and a felt belt 110 having a closed or smooth surface may be guided through rear extended press nip P2.

Felt or screen belt 108 may be guided around guide roll 112 before being guided through front extended press nip P1. Further, felt or screen belt 108 may be guided in web run direction L to take up fibrous pulp web 10, created on screen belt 36 of the screen section, in a vicinity of a guide roll 112.

Guide roll 112 may be arranged slightly below mating roll 104 associated with shoe press 102 so that fibrous pulp sheet 10 may be guided together with felt or screen belt 108 diagonally upward toward press nip P1. As a result, felt or screen belt 108 and fibrous pulp sheet 10 may be tangentially brought into contact with mating roll 104 in an area before press nip P1 so that a ridge, e.g., created of formed by press sleeve 100 in front of press nip P1, does not have a negative impact.

Felt belt 110 may be tangentially brought into contact with mating roll 106 from above before being fed into press nip P2. Felt belt 110 may leaves press nip P2 substantially horizontally, and, afterwards, may be deflected diagonally upwards by a guide roll 114 positioned at a distance from press nip P2. It is noted that felt or screen belts 108 and 110 may be formed by endless belts.

Fibrous pulp sheet 10 may be transferred from press sleeve 100 of the long-slit press unit, including press sleeve 100 and press shoes 96 and 98, to dryer cylinder 42 of the dryer section by a felt or screen belt 40 guided around a guide roll 38. A scraper 116 may be associated with the long-slit press unit and positioned below the transfer location to the dryer section.

In each of the illustrated embodiments of the present invention, an adjustable pressure distribution of the respective press nips may be regulated at least perpendicular to web run direction L.

In the described embodiments of a press section of the present invention, the number of press locations may be reduced to a minimum. Overall, less space for construction is required and the number of rolls may be kept relatively small. All embodiment variations ensure an easy uptake and transfer of the fibrous pulp web and the respective reverse moistening is reduced to a minimum. In particular a minimal two-sidedness is guaranteed due to the use of an additional smoothing slit. An even more compact construction results since additional uptake roll can be eliminated, which further reduces energy usage. Overall a very gentle draining with respect to the volume is ensured. Due to the additional smoothing slit, substantially all remaining felt markings may be eliminated and the two-sidedness may be reduced. The appropriate smoothing roll can also ensure the respective rotational direction reversal needed to accomplish the transfer in the drying section. Of particular advantage is the resulting closed web guidance. With the flexible press sleeves, preferably sealed on their face sides, the present invention ensured that lubricating materials supplied to the press shoes and, in particular, coolants pressurizing the press sleeve, e.g., oil and water, cannot leak to the exterior.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

| Reference List |
|---|
| 10 fibrous pulp web |
| 12 press roll |
| 14 press shoe |
| 16 press shoe |
| 18 press sleeve |
| 20 press sleeve |
| 22 support element |
| 24 support element |
| 26 felt or screen belt |
| 28 felt belt |
| 30 guide roll |
| 31 guide roll |
| 32 smoothing roll |
| 34 support element |
| 36 screen belt |
| 38 guide roll |
| 40 felt or screen belt |
| 42 drying cylinder |
| 44 carrier |
| 46 force unit |
| 48 supply line |
| 50 carrier |
| 52 guide roll |
| 54 guide roll |
| 56 guide roll |
| 58 guide roll |
| 60 scraper |
| 62 trough |
| 64 steam blow box |

-continued

| Reference List | |
|---|---|
| 66 | spray nozzle |
| 68 | blow nozzle |
| 70 | scraper |
| 72 | smoothing press |
| 74 | smooth belt |
| 76 | guide roll |
| 78 | guide roll |
| 80 | smoothing roll |
| 82 | smoothing roll |
| 84 | press sleeve |
| 86 | smoothing roll |
| 88 | press shoe |
| 90 | guide roll |
| 92 | guide roll |
| 94 | scraper |
| 96 | press shoe |
| 98 | press shoe |
| 100 | flexible roll sleeve |
| 102 | shoe roll |
| 104 | mating roll |
| 106 | mating roll |
| 108 | felt or screen belt |
| 110 | felt belt |
| 112 | guide roll |
| 114 | guide roll |
| 116 | scraper |
| G | smoothing slit |
| L | web run direction |
| P1 | frontal press nip |
| P2 | rear press nip |

What is claimed:

1. A press section of a machine for manufacturing a fibrous pulp web comprising:

a press roll having a smooth roll surface;

at least one flexible circulating press belt;

at least two press shoes positioned opposite the press roll and offset with respect to each other in a circumferential direction to the press roll, such that a direction of force exerted by each of the at least two press shoes extends substantially through an axis of the press roll and defines an acute angle;

a plurality of extended press nips, each of the plurality of extended press nips being formed to extend in a web run direction by a respective one of the at least two press shoes pressing the flexible circulating press belt against the press roll;

support elements located within the press roll and positioned opposite the at least two press shoes to support the press roll at the plurality of extended press nips;

one of a felt or screen belt being guided through at least one of the plurality of extended nips; and the press roll being substantially centrally located within the press section and having an outer diameter greater than a diameter of the at least one flexible circulating press belt, wherein the outer diameter of the press roll is greater than approximately 1500 mm.

2. The press section in accordance with claim 1, the outer diameter of the press roll being approximately 2000 mm.

3. The press section in accordance with claim 1, the press roll being composed of an adjustable bending roll that is supported along an interior surface.

4. The press section in accordance with claim 1, a separate flexible circulating press belt associated with each of the at least two press shoes.

5. The press section in accordance with claim 4, a single felt belt associated within each of the plurality of extended press nips.

6. The press section in accordance with claim 5, the plurality of extended press nips comprising a front and rear extended press nip that extend in the web run direction;

one of a felt or screen belt having an open surface guided on a side of the fibrous pulp web facing the at least two press shoes through the front extended press nip; and the single felt belt, having a smooth surface guided on a side of the fibrous pulp web facing the at least two press shoes through the rear extended press nip.

7. The press section in accordance with claim 1, at least one of the at least two press shoes being positioned directly underneath the press roll; and a direction of force exerted by the at least one of the at least two press shoes lies in a substantially vertical plane extending substantially through an axis of the press roll.

8. The press section in accordance with claim 1, the at least one flexible circulating press belt comprising a press sleeve circulating around a non-rotating carrier and guided over the at least one of the at least two press shoes.

9. The press section in accordance with claim 1, each of the at least one flexible circulating press belt comprising a press sleeve circulating around a non-rotating carrier and guided over the at least one of the at least two press shoes.

10. The press section in accordance with claim 9, the at least two press shoes comprising two successively arranged press shoes arranged opposite the press roll;

each at least one circulating flexible roll sleeve being guided over a respective one of the two successively arranged press shoes; and an outer diameter of the press roll being greater than a diameter of each of the press sleeves.

11. The press section in accordance with claim 10, the press sleeves having substantially equal outer diameters.

12. The press section in accordance with claim 1, further comprising a smoothing slit formed between two smooth surfaces;

the smoothing slit being positioned after, in the web run direction, at least one of the plurality of extended press nips to drain the fibrous pulp sheet.

13. The press section in accordance with claim 12, the at least one extended press nip being a last press nip formed by the press roll in the web run direction.

14. The press section in accordance with claim 12, the smoothing slit being formed by a smooth roll sleeve of the press roll and a smooth roll sleeve of a smoothing roll positioned opposite the press roll.

15. The press section in accordance with claim 14, the smoothing roll comprising at least one interior support element for supporting the smooth roll sleeve of the smoothing roll and for pressing against the press roll.

16. The press section in accordance with claim 12, the press roll having an outer diameter treater than a diameter of the smoothing roll.

17. The press section in accordance with claim 12, further comprising a screen section and a screen belt, the screen section forming the fibrous pulp web on the screen belt; and the press roll positioned to immediately take up the fibrous pulp web from the screen belt.

18. The press section in accordance with claim 1, the acute angle measuring less than approximately 45°.

19. A press section of a machine for manufacturing a fibrous pulp web comprising:

a press roll;

at least one flexible circulating press belt;

at least two press shoes positioned opposite the press roll and offset with respect to each other in a circumferential direction to the press roll, such that a direction of force exerted by each of the at least two press shoes extends substantially through an axis of the press roll and defines an acute angle;

a plurality of extended press nips, each of the plurality of extended press nips being formed to extend in a web run direction by a respective one of the at least two press shoes pressing the flexible circulating press belt against the press roll;

support elements located within the press roll and positioned opposite the at least two press shoes to support the press roll at the plurality of extended press nips;

one of a felt or screen belt being guided through at least one of the plurality of extended nips;

the press roll being substantially centrally located within the press section and having an outer diameter greater than a diameter of the at least one flexible circulating press belt; and the fibrous pulp web comprising one of a paper or a cardboard web.

20. A press section of a machine for manufacturing a fibrous pulp web comprising:

a press roll;

at least one flexible circulating press belt;

at least two press shoes positioned opposite the press roll and offset with respect to each other in a circumferential direction to the press roll, such that a direction of force exerted by each of the at least two press shoes extends substantially through an axis of the press roll and defines an acute angle;

a plurality of extended press nips, each of the plurality of extended press nips being formed to extend in a web run direction by a respective one of the at least two press shoes pressing the flexible circulating press belt against the press roll;

support elements located within the press roll and positioned opposite the at least two press shoes to support the press roll at the plurality of extended press nips;

one of a felt or screen belt being guided through at least one of the plurality of extended nips;

the press roll being substantially centrally located within the press section and having an outer diameter greater than a diameter of the at least one flexible circulating press belt; and at least one of the at least two press shoes having a concave press profile.

21. The press section in accordance with claim 20, the concave press profile substantially corresponding with a curvature an outer surface of the press roll.

* * * * *